US012680331B2

(12) United States Patent
Yue

(10) Patent No.: US 12,680,331 B2
(45) Date of Patent: Jul. 14, 2026

(54) CARBON FIBER ROOFTOP TENT

(71) Applicant: SHENZHEN YANGNING AUTO ACCESSORY CO., LTD, Shenzhen (CN)

(72) Inventor: Shiawdar Shaun Yue, Shenzhen (CN)

(73) Assignee: SHENZHEN YANGNING AUTO ACCESSORY CO., LTD, Shenzhen (CN)

( * ) Notice: Subject to any disclaimer, the term of this patent is extended or adjusted under 35 U.S.C. 154(b) by 328 days.

(21) Appl. No.: 18/494,823

(22) Filed: Oct. 26, 2023

(65) Prior Publication Data

US 2025/0137280 A1 May 1, 2025

(51) Int. Cl.
*E04H 15/06* (2006.01)
*E04H 15/48* (2006.01)
*E04H 15/58* (2006.01)

(52) U.S. Cl.
CPC ..... *E04H 15/06* (2013.01); *E04H 15/48* (2013.01); *E04H 15/58* (2013.01)

(58) Field of Classification Search
CPC ..... E04H 15/06; E04H 15/008
See application file for complete search history.

(56) References Cited

U.S. PATENT DOCUMENTS

| | | | | |
|---|---|---|---|---|
| 9,995,055 | B1 * | 6/2018 | Currid | E04H 15/06 |
| 10,077,574 | B1 * | 9/2018 | Currid | B60P 3/343 |
| 11,203,279 | B1 * | 12/2021 | Tatro | E04H 15/48 |
| 11,560,732 | B2 * | 1/2023 | Montesalvo | B60P 3/38 |
| 11,753,844 | B2 * | 9/2023 | Dunn | B60P 3/38 135/88.14 |
| 2023/0322148 | A1 * | 10/2023 | Wilkerson | E04H 15/06 296/173 |
| 2024/0360688 | A1 * | 10/2024 | Ardmar | E04H 15/06 |
| 2025/0059793 | A1 * | 2/2025 | Robertson | E06C 1/12 |

FOREIGN PATENT DOCUMENTS

| | | | | |
|---|---|---|---|---|
| CN | 208347428 | U | 1/2019 | |
| CN | 214303150 | U | 9/2021 | |
| CN | 221298777 | U | 7/2024 | |
| WO | 2005005754 | A1 | 1/2005 | |
| WO | WO-2019064010 | A1 * | 4/2019 | H02S 20/10 |

* cited by examiner

*Primary Examiner* — Noah Chandler Hawk
(74) *Attorney, Agent, or Firm* — HOWARD M COHN and Associates, LLC

(57) ABSTRACT

A carbon fiber rooftop tent is disclosed. The carbon fiber rooftop tent includes a tent bracket assembly and a tent fabric assembly fixed to the tent support assembly. The tent support assembly includes a base, an upper cover, and at least one support rod. The base is to be mounted on top of an automobile. One end of the upper cover is connected to one end of the base through a hinge. The upper cover is rotatable relative to the base by means of the hinge. The at least one support rod is disposed between the base and the upper cover for supporting the upper cover. One end of the at least one support rod is connected to the base, and another end of the at least one support rod is connected to the upper cover. The upper cover is at least partially made of a carbon fiber material.

18 Claims, 9 Drawing Sheets

CARBON FIBER ROOFTOP TENT

TECHNICAL FIELD

This application relates to the field of rooftop tents, and more particularly relates to a carbon fiber rooftop tent.

BACKGROUND

With the growth of the economy, the increase of per capita income, and the increasing number of private automobile ownership, self-drive tours have become an emerging way of tourism. In order to meet the convenience of people's self-drive tours, rooftop tents attached to the automobiles are becoming more and more popular. A rooftop tent is a tent that can be set up on the rooftop of an automobile. Because it is not as close to the ground as other tents when in use, the rooftop tent is not susceptible to the intrusion of ground-level air and moisture, making it more comfortable to use.

In order to ensure the stability and safety of rooftop tents, rooftop tents may be relatively heavy. This makes it inconvenient to install the rooftop tent on the rooftop of the automobile, and may also increase the load on the automobile, making it inconvenient to use.

SUMMARY

In view of the above, it is a purpose of this application to provide a carbon fiber rooftop tent to reduce the weight of the rooftop tent and make the rooftop tent more convenient to use.

This application discloses a carbon fiber rooftop tent, which includes a tent support assembly and a tent fabric assembly. The tent fabric assembly is fixed to the tent support assembly. The tent fabric assembly is fixed to the tent support assembly. The tent support assembly includes a base, an upper cover, and a support rod. The base is intended to be mounted on top of an automobile. One end of the upper cover is connected to one end of the base through a hinge. The upper cover is rotatable relative to the base by means of the hinge. The support rod is disposed between the base and the upper cover for supporting the upper cover. The upper cover is at least partially made of a carbon fiber material.

Since an end of the base and an end of the upper cover are connected through the hinge, to use the carbon fiber rooftop tent in this application, one end of the upper cover may be simply directly lifted. At this time, the upper cover is fixed by the support rod and will not fall, so the user can enter the tent. When the carbon fiber rooftop tent is not to be used, the user can press the upper cover and close the upper cover with the base to complete the folding of the tent, which greatly facilitates use by the user. In addition, since the upper cover of the carbon fiber rooftop tent is at least partially made of a carbon fiber material, and the carbon fiber material itself is lightweight, so it can reduce the weight of the carbon fiber rooftop tent, thereby facilitating the installation and transportation of the carbon fiber rooftop tent, and reducing the load on the automobile.

BRIEF DESCRIPTION OF DRAWINGS

The accompanying drawings are used to provide a further understanding of the embodiments according to this application, and constitute a part of the specification. They are used to illustrate the embodiments according to this application, and explain the principle of this application in conjunction with the text description. Apparently, the drawings in the following description merely represent some embodiments of this disclosure, and for those having ordinary skill in the art, other drawings may also be obtained based on these drawings without investing creative efforts. A brief description of the accompanying drawings is provided as follows.

Figure 1:
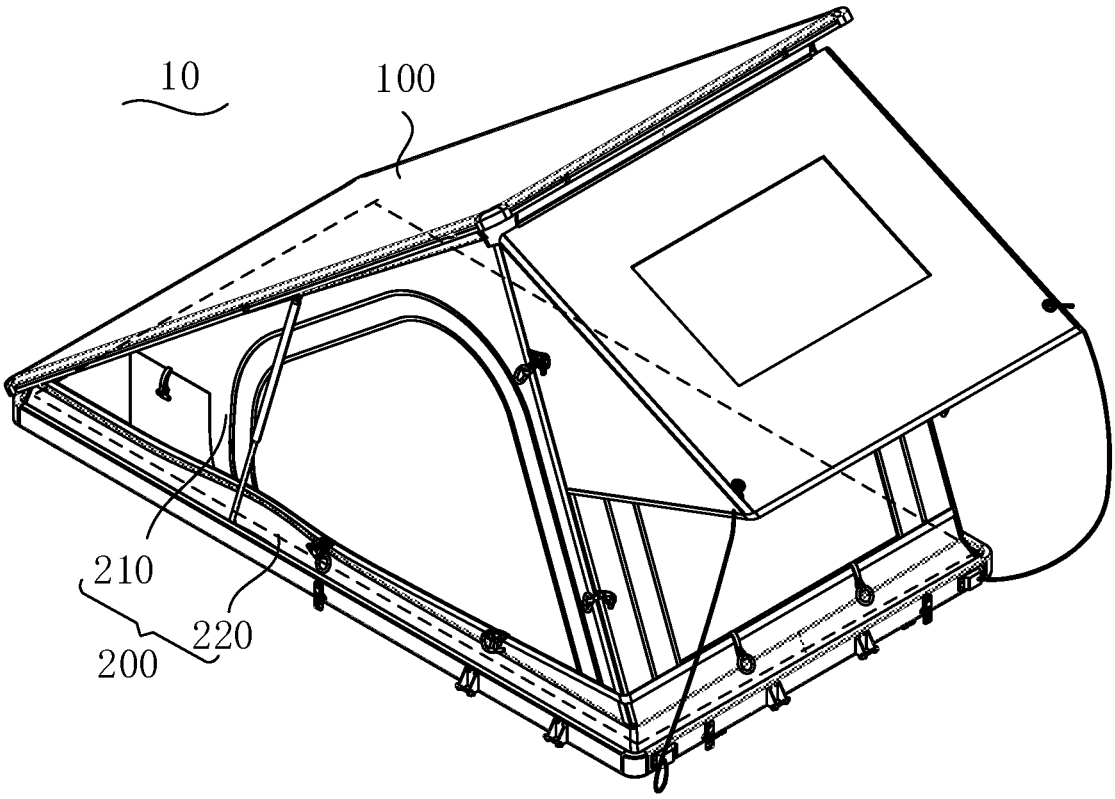
FIG. 1 is a schematic diagram of a carbon fiber rooftop tent provided by an embodiment of this application when deployed.

In the drawings: 10. Carbon fiber rooftop tent; 100. Tent support assembly; 110. Upper cover; 111. Framework; 1111. Upper frame; 1111*a*. First frame bar; 1111*b*. Second frame bar; 1111*d*. Corner wrapper; 1111*e*. Fitting groove; 1111*f*. Channel; 1111*g*. Fitting notch; 1112. Upper crossbar; 112. Top plate; 120. Base; 121. Lower frame; 1211. Insertion socket; 122. Lower crossbar; 123. Mounting and fixing bar; 1231. Fixing rail; 1231*a*. Mounting position; 1231*b*. First screw hole; 1232. Second screw hole; 124. Insert seat; 1241. Insert hole; 125. Ladder buckle; 130. Support rod; 140. Hinge; 150. Accommodating chamber; 151. First receiving groove; 152. Second receiving groove; 200. Tent fabric assembly; 210. Fabric; 211. Main body; 2111. Parent buckle; 212. Portiere; 213. Window curtain; 2131. Window screen; 2132. Fabric curtain; 214. Shielding piece; 2141. Fixing ring; 2142. Transparent piece; 215. Duct; 216. Sealing piece; 220. Mat; 230. Pull rod; 240. Item bag; 241. Child buckle; 300. Fastening assembly; 310. First fastening piece; 320. Second fastening piece.

DETAILED DESCRIPTION OF EMBODIMENTS

It should be understood that the terms used herein, the specific structures and function details disclosed herein are intended for the mere purposes of describing specific embodiments and are representative. However, this application may be implemented in many alternative forms and should not be construed as being limited to the embodiments set forth herein.

Hereinafter this application will be described in further detail with reference to the accompanying drawings and some optional embodiments.

Figure 2:
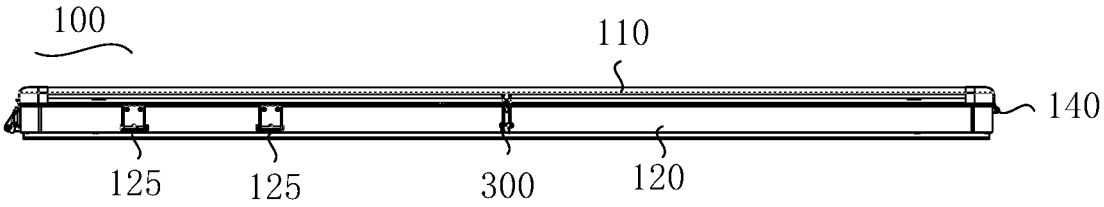
FIG. 2 is a schematic diagram of a carbon fiber rooftop tent provided by an embodiment of this application when folded.

Embodiments of this application provide a carbon fiber rooftop tent. The carbon fiber rooftop tent 10 is mounted on the top of an automobile to provide users with a comfortable sleeping environment for self-drive tours and wild camping. FIG. 1 is a schematic diagram of a carbon fiber rooftop tent 10 when unfolded. As shown in FIG. 1, when the carbon fiber rooftop tent 10 is unfolded, the carbon fiber rooftop tent 10 forms a triangular prism structure. Both the section at its front and the sections at the sides are stable triangular structures, thus forming a relatively large space inside the carbon fiber rooftop tent 10. At this time, the user can enter the interior of the carbon fiber rooftop tent 10 from the sides and the front of the carbon fiber rooftop tent 10. FIG. 2 is a schematic diagram of the carbon fiber rooftop tent 10 when folded. As shown in FIG. 2, when the carbon fiber rooftop tent 10 is folded, the carbon fiber rooftop tent 10 forms a plate-like structure that lies flat on the top of the automobile, which will not cause air resistance when the automobile is driving and meanwhile has sasfactory stability.

As can be seen from FIGS. 1 and 2, the carbon fiber rooftop tent 10 includes a tent support assembly 100 and a tent fabric assembly 200. The tent fabric assembly 200 is fixed to the tent support assembly 100 and blocks the side of the tent support assembly 100.

Regarding the tent support assembly 100, the specific design is as follows.

Figure 3:
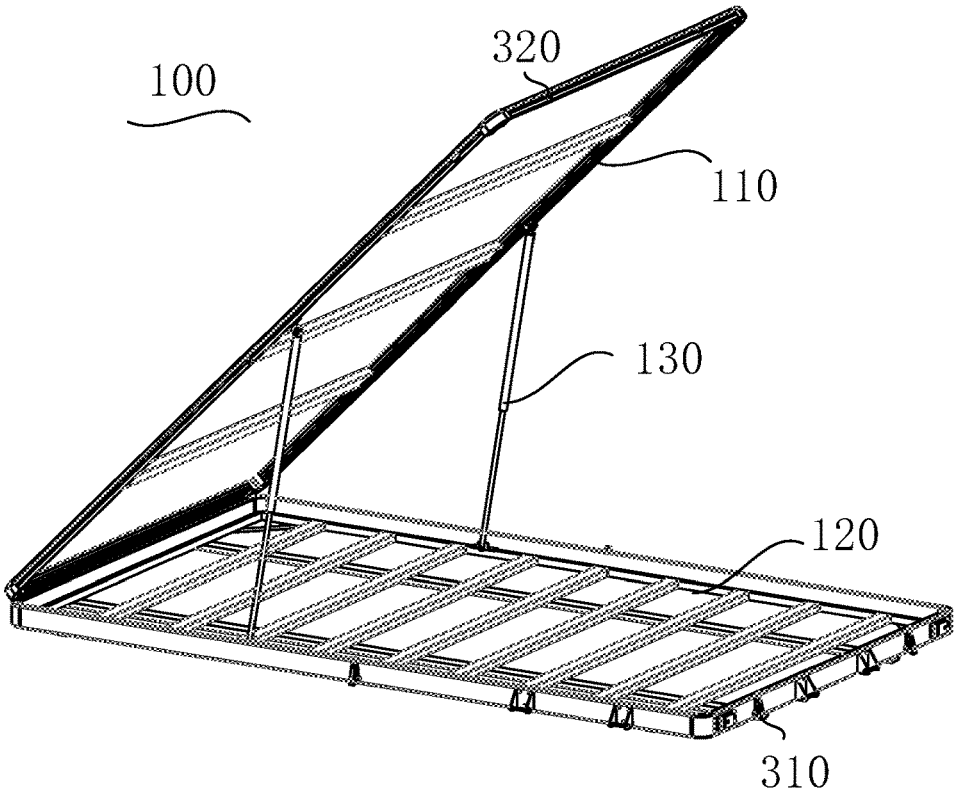
FIG. 3 is a schematic diagram of a tent support assembly provided by an embodiment of this application when deployed.

FIG. 3 is a schematic diagram of the tent support assembly when unfolded. As shown in FIGS. 2 and 3, the tent support assembly 100 includes a base 120, an upper cover 110, and a support rod 130. The base 120 is used to be mounted on the top of an automobile. One end of the upper cover 110 and one end of the base 120 are connected through a hinge 140. The upper cover 110 and the base 120 rotate relative to each other by means of the hinge 140. The support rod 130 is disposed between the base 120 and the upper cover 110 for supporting the upper cover 110. One end of the support rod 130 is connected to the base 120, and the other end of the support rod 130 is connected to the upper cover 110. The upper cover 110 is at least partially made of a carbon fiber material.

After adopting the above design, since one end of the base 120 and one end of the upper cover 110 are connected through the hinge 140, when the carbon fiber rooftop tent 10 in this application is used, an end of the upper cover 110 may be directly lifted up and the tent fabric assembly 500 would accordingly be driven to expand. At this time, the upper cover 110 is fixed by the support rod 130 and will not fall, so that the rooftop tent 10 is in an unfolded state and the user can enter the tent. When the carbon fiber rooftop tent 10 is not in use, the upper cover 110 may be pressed and the tent fabric assembly 500 may accordingly be folded, to the extent to which the upper cover 110 is closed with the base 120 thus realizing the folding of the tent, which greatly facilitates the use by the user. In addition, since the upper cover 110 of the carbon fiber rooftop tent 10 is at least partially made of the carbon fiber material, which is relatively light, the weight of the carbon fiber rooftop tent 10 can be reduced, thereby facilitating the installation and transportation of the carbon fiber rooftop tent 10 and reducing the load on the automobile.

Figure 4:
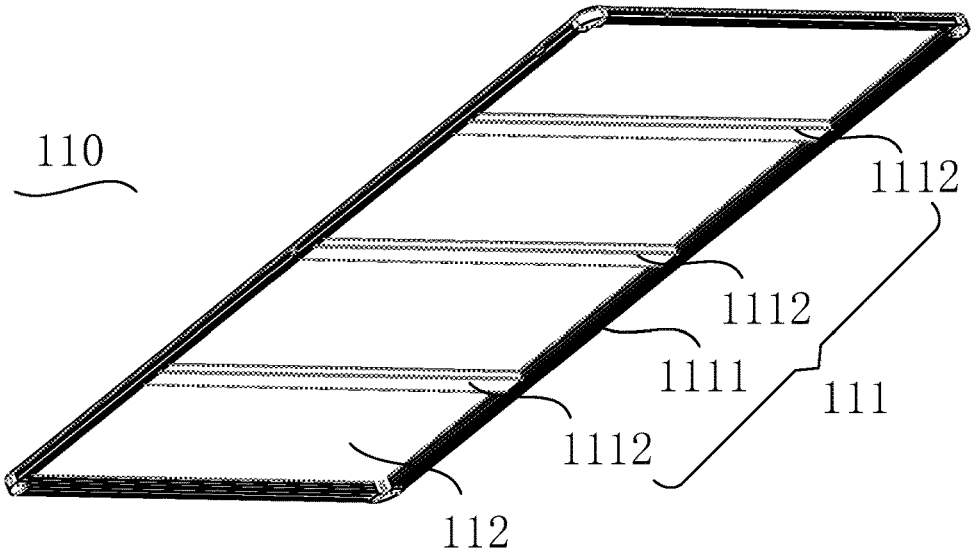
FIG. 4 is an overall schematic diagram of an upper cover provided by an embodiment of this application.
Figure 5:
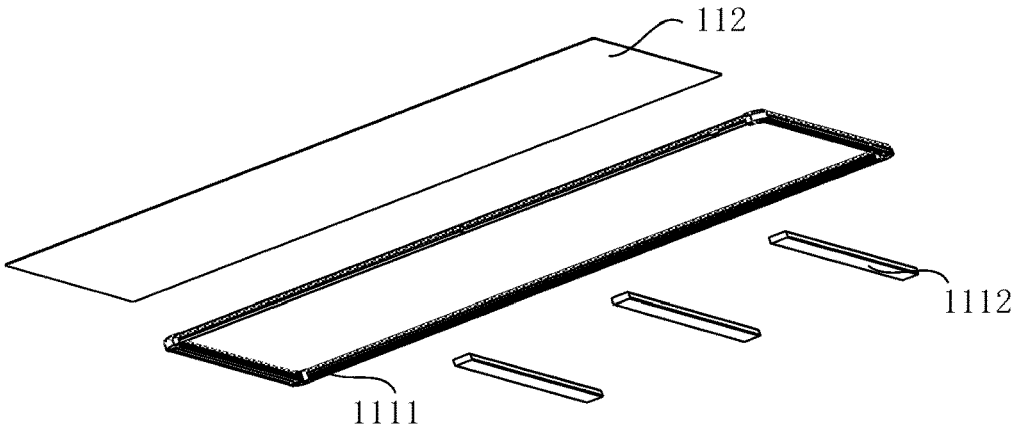
FIG. 5 is an exploded schematic diagram of an upper cover provided by an embodiment of this application.

FIG. 4 is an overall schematic diagram of the upper cover. FIG. 5 is an exploded diagram of the upper cover. As shown in FIGS. 4 and 5, the upper cover 110 includes a framework 111 and a top plate 112. The upper frame 1111 is a rectangular framework. The top plate 112 is a one-piece rectangular plate. The four side edges of the top plate 112 are fixedly connected to the upper frame 1111. The three upper crossbars 1112 are disposed below the top plate 112 and are fixed at intervals to both sides of the upper frame 1111 to support the middle area of the top plate 112 and prevent the top plate 112 from sinking and breaking when subjected to external pressure.

Figure 6:
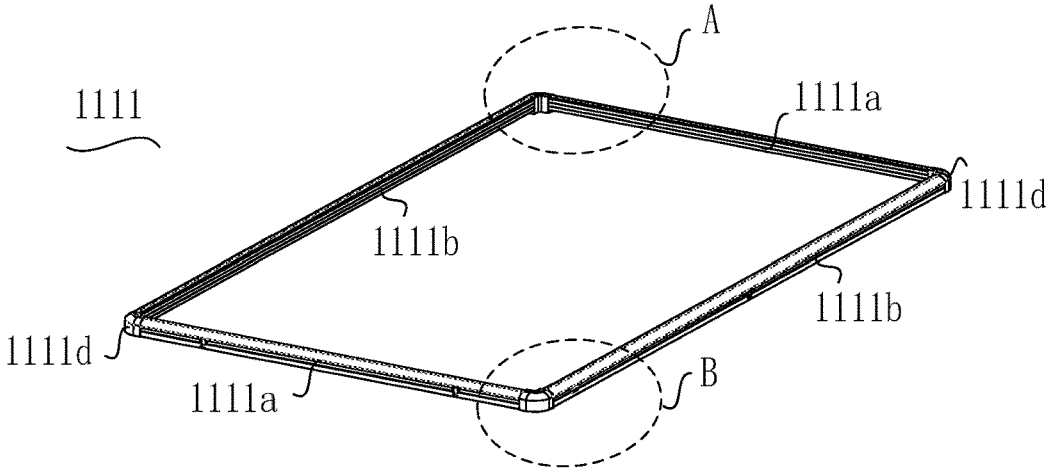
FIG. 6 is a schematic diagram of an upper frame provided by an embodiment of this application.

Specifically, as shown in FIG. 6, the upper frame 1111 is an assembled structure, including two first frame bars 1111*a*, two second frame bars 1111*b*, and four corner wrappers 1111*d*. The two first frame bars 1111*a* constitute the two short sides of the upper frame 1111. The two second frame bars 1111*b* constitute the two long sides of the upper frame 1111. The four corner wrappers 1111*d* constitute the four corner wrappers of the upper frame 1111.

The outer contour of the corner wrapper 1111*d* is arc-shaped, and both ends of the corner wrapper 1111*d* are hollow. The ends of the first frame bar 1111*a* and the second frame bar 1111*b* that are adjacent to each other are respectively inserted into the two ends of a corner wrapper 1111*d*, so that the two first frame bars 1111*a*, the two second frame bars 1111*b*, and the four corner wrappers 1111*d* are connected to form an annular upper frame 1111. Of course, the upper frame 1111 may also be an integrally formed structure, which may be particularly selected according to the actual situation.

Figure 7:
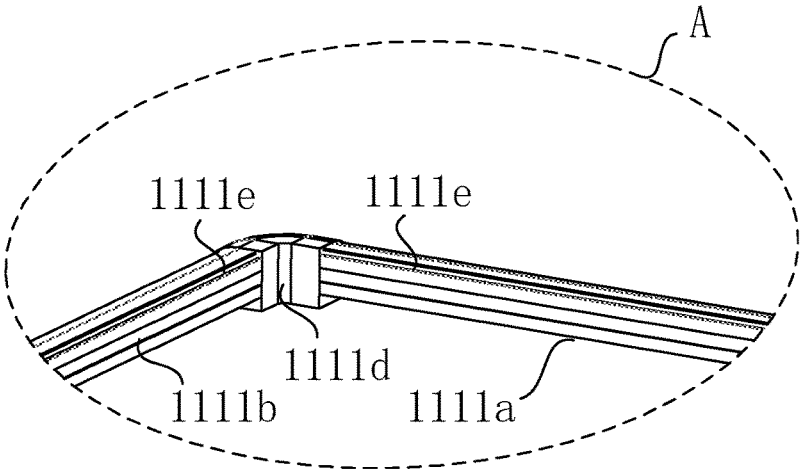
FIG. 7 is an enlarged schematic view of part A shown in FIG. 6.

As shown in FIG. 7, a fitting groove 1111*e* is defined in the top of an inner wall of each of the first framework 1111*a* and the second framework 1111*b*, so that an annular fitting groove 1111*e* is formed in the top of the inner walls of the upper frame 1111. The edges of the top plate 112 are inserted into and clamped in the fitting groove 1111*e*.

The inner wall of each second frame bar 1111*b* further defines three spaced openings, and both ends of each upper crossbar 1112 are respectively inserted into the two opposite openings of the second frame bars 1111*b*. When assembling the upper cover 110, the four edges of the top plate 112 may be inserted into the fitting grooves 1111*e* in the first frame bars 1111*a* and the second frame bars 1111*b* respectively, and the two ends of each of the three upper crossbars 1112 may be inserted into the openings of the two second frame bars 1111*b*, and then the four corner wrappers 1111*d* may be added, thus realizing the assembly of the upper cover 110.

Furthermore, connection glue can be added to the junctions between the first frame bars 1111*a*, the second frame bars 1111*b*, the corner wrappers 1111*d*, the upper crossbars 1112, and the top plates 112 to improve the connection strength of the above structure and the durability of the upper cover 110.

Furthermore, a waterproof glue may be coated on the top of the upper cover 110, that is, at the junction of the top plate 112 and the upper frame 1111, to prevent external rainwater and air from entering the interior of the carbon fiber rooftop tent 10 through the gap between the top plate 112 and the upper frame 1111 and causing water leakage and air leakage problems.

In the carbon fiber rooftop tent 10 provided by this application, the entire top plate 112 may be made of the carbon fiber material. In current rooftop tents, the top plate 112 may be a hard shell made of ABS plastic or PC plastic, which has relatively poor performance in terms of UV resistance, heat resistance, impact resistance, pressure resistance, wear resistance, flame retardancy, etc., which may easily cause deformation and cracking if used in high temperature and cold environments for a long time. Furthermore, the entire top plate 112 is relatively large in area and heavy in weight, making assembly troublesome, which may also increase the overall weight of the carbon fiber rooftop tent 10. Since the carbon fiber material is not only lightweight, but also has satisfactory UV resistance, heat resistance, wear resistance and other properties, which can greatly reduce the overall weight of the carbon fiber rooftop tent 10 and increase the service life of the carbon fiber rooftop tent 10.

It should be noted that in the upper cover 110, the number of the upper crossbars 1112 may not be three, but may be less than three or more than three. The framework 111 may also adopt a hollow grille structure instead of the structure composed of the upper frame 1111 and the upper crossbars 1112. The top plate 112 may also be fixed to the top of the upper frame 1111 through a snap-fit connection, a screw connection, etc., instead of being fixed in the inner wall of the upper frame 1111; the above designs may be selected according to the actual situation.

Figure 8:
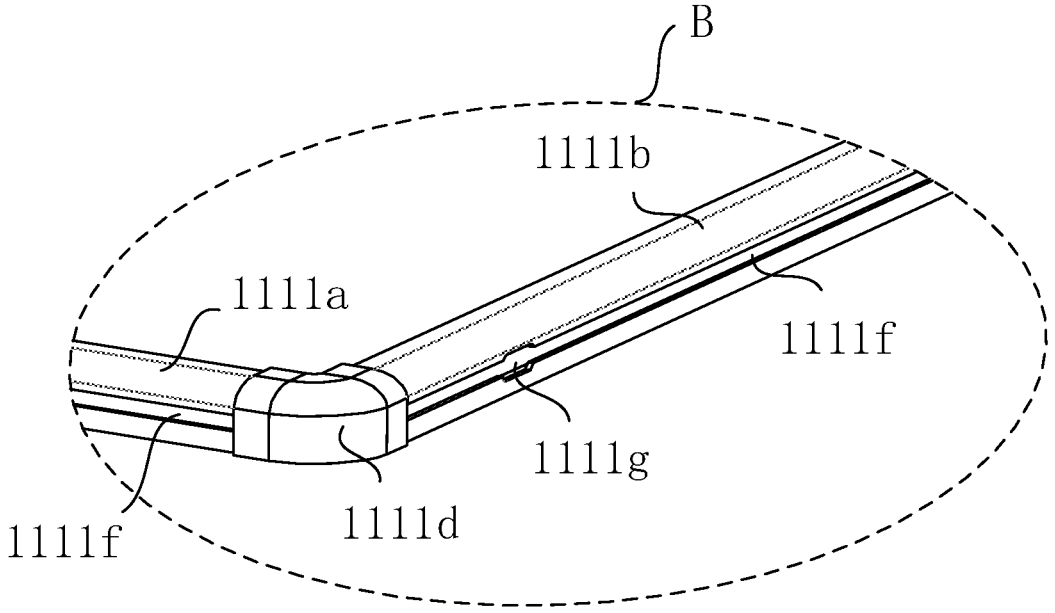
FIG. 8 is an enlarged schematic view of part B in FIG. 6.

As shown in FIG. 8, the outer walls of the first frame bars 1111*a* and the second frame bars 1111*b* also have channels 1111*f* extending along their length directions. The channels 1111*f* are used to install parts such as locks and hinges 140.

Each of the channels 1111*f* in the first frame bars 1111*a* and the second frame bars 1111*b* has a fitting notch 1111*g*. The width of the fitting notch 1111*g* is greater than the width of the rest of the channel 1111*f*, and is used to install equipment placed on the top of the upper cover 110, such as bicycles, luggage, etc.

Figure 9:
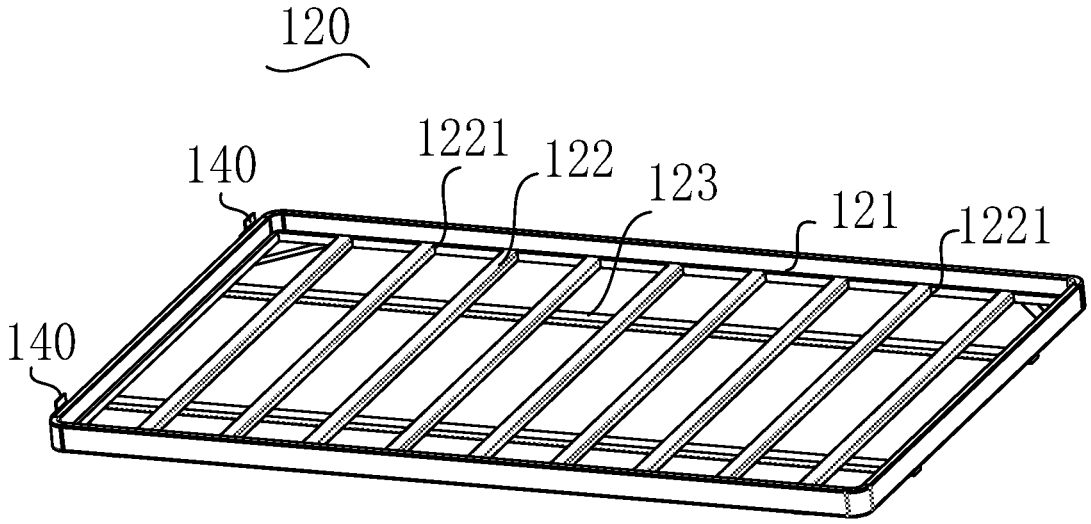
FIG. 9 is a schematic front view of a base provided by an embodiment of this application.

FIG. 9 is a schematic diagram of a base 120 in the carbon fiber rooftop tent 10. As shown in FIG. 9, the base 120 includes a lower frame 121, nine spaced lower crossbars 122, and two spaced mounting and fixing bars 123. The lower frame 121 is a rectangular framework, and the outline of the lower frame 121 is the same as that of the upper frame 1111. When the carbon fiber rooftop tent 10 is folded, the bottom of the lower frame 121 abuts against the top of the upper frame 1111.

The lower crossbars 122 are arranged parallel to the upper crossbars 1112 in the upper cover 110, and both ends of each lower crossbar 122 are connected to the two opposite long sides of the lower frame 121 respectively. The mounting and fixing bars 123 are each arranged perpendicularly to the lower crossbars 122, and the two ends of each mounting and fixing bar 123 are respectively connected to the two opposite short sides of the lower frame 121. The lower frame 121 may be in the form of a combination of long and short sides as independent profiles, or it may also adopt an integrated structure. A plurality of insertion sockets 1211 are disposed in the inner walls of the two long sides of the lower frame 121. Both ends of each lower crossbar 122 are inserted into the respective insertion sockets 1211 so as to be connected to the lower frame 121. The two ends of each mounting and fixing bar 123 are fixed to the bottom of the lower frame 121 through screw connections. The mounting and fixing bars 123 are all located below the lower crossbars 122, that is, the lower crossbars 122 are disposed between the mounting and fixing bars 123 and the upper cover 110.

At least one of the lower crossbars 122 is made of a carbon fiber material to further reduce the overall weight of the carbon fiber rooftop tent 10. Furthermore, the thermal conductivity of the carbon fiber material is worse than that of metal, which may prevent a plenty of heat from being conducted to the metal rails from the top shell of the automobile in hot weather outdoors such that the thermally conducted heat may increase thus causing the internal temperature of the carbon fiber rooftop tent 10 to be too high when in use and affecting the use experience.

As a specific example, in the carbon fiber rooftop tent 10, let the end where the hinge 140 is located be the rear end, and the end opposite to the rear end be the front end. A plurality of lower crossbars 122 are arranged in sequence along the direction from the front end to the rear end. The two lower crossbars 122 near the front end are made of an aluminum alloy material, and the remaining lower crossbars 122 are made of the carbon fiber material. When the carbon fiber rooftop tent 10 is unfolded and used, the user may enter from the front end of the carbon fiber rooftop tent 10 and may step on the front end of the base 120. At this time, the lower frame 121, the lower crossbars 122 and the mounting and fixing bars 123 at the front end are stressed, especially the two lower crossbars 122 disposed at the front end are under relatively greater stress. Since the toughness of the carbon fiber material is relatively poor, in order to prevent the lower crossbars 122 at the front end from breaking, they are made by an aluminum alloy material with relatively better strength and toughness. In this case, only two lower crossbars 122 are made of aluminum alloy material, while the remaining seven lower crossbars 122 are made of the carbon fiber material, which will not cause the overall weight of the carbon fiber rooftop tent 10 to increase too much.

It should be noted that the number of lower crossbars 122 in the base 120 may not be nine, and may alternatively be less than nine or may be greater than nine. The number of mounting and fixing bars 123 in the base 120 may not be two, and may alternatively be less than two or more than two. Furthermore, the lower crossbars 122 in the base 120 may alternatively be replaced with a hollow mesh structure made of the carbon fiber material or a structure arranged in other ways. The above-mentioned designs may be specifically selected based on actual conditions and shall all fall in the scope of protection of this application.

Figure 10:
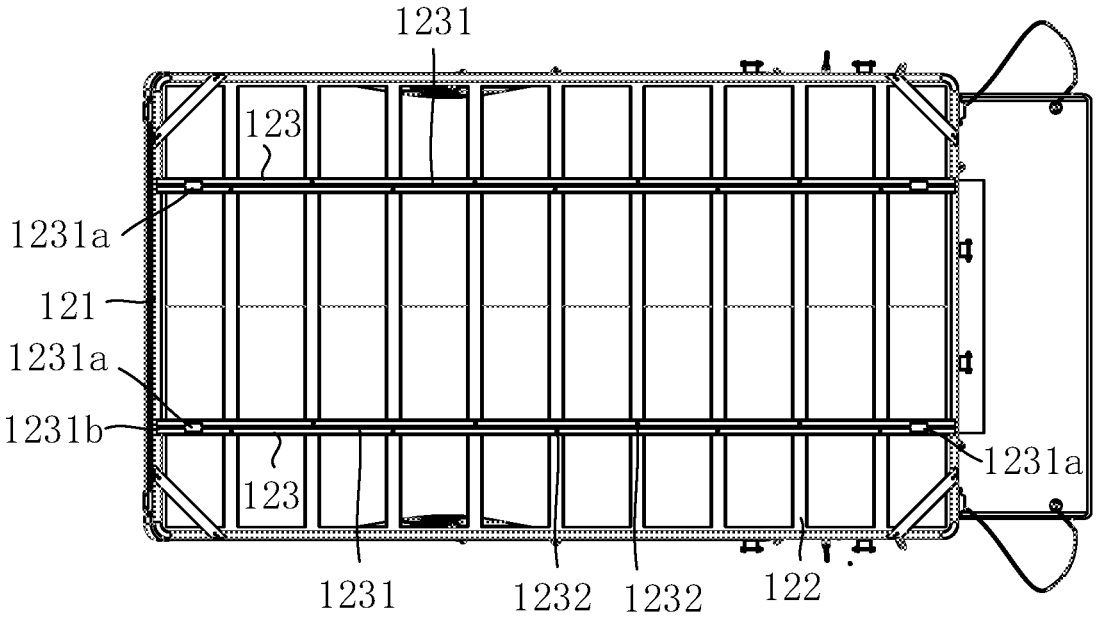
FIG. 10 is a schematic bottom view of a base provided by an embodiment of this application.
Figure 11:
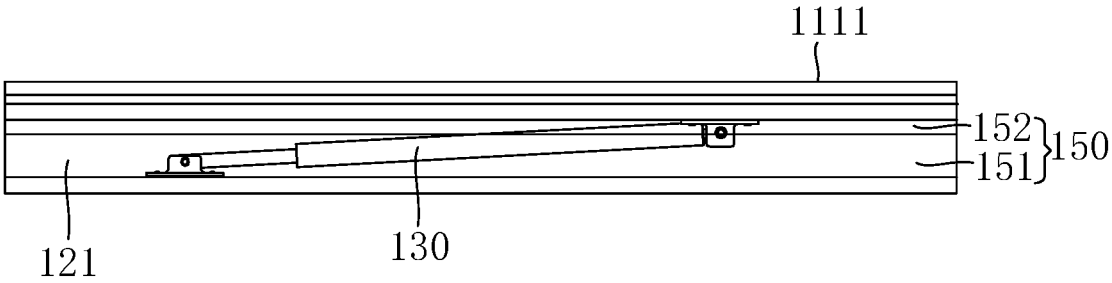
FIG. 11 is a schematic diagram of the interior of a tent support assembly when it is folded.

As shown in FIG. 10, at the bottom of the base 120, a fixing rail 1231 is disposed on the side of each mounting and fixing bar 123 facing away from the lower crossbars 122. The fixing rail 1231 includes a plurality of mounting positions 1231*a* for fixing to the automobile. The carbon fiber rooftop tent 10 is fixed to the top of the automobile by means of the mounting positions 1231*a*. Each fixing rail 1231 extends along a length of the mounting and fixing bar 123. At least one first screw hole 1231*b* is defined at each of both ends of the fixing rail 1231. The first screw hole 1231*b* corresponds to the bottom of the lower frame 121. Each mounting and fixing bar 123 is fixed to the bottom of the lower frame 121 with screws to ensure the connection strength of the mounting and fixing bar 123.

In addition, the mounting and fixing bar 123 further defines a plurality of second screw holes 1232, which are disposed in one-to-one correspondence with the lower crossbars 122. The second screw holes 1232 are defined outside the fixing rail 1231, and the second screw holes 1232 are alternately disposed on both sides of the fixing rail 1231. That is, the former second screw hole 1232 is located on one side of the fixing rail 1231, and the latter second screw hole 1232 is located on the other side of the fixing rail 1231. The mounting and fixing bar 123 is connected to the lower crossbars 122 through screws to further improve the stability of the base 120.

In the embodiments of this application, the upper crossbars 1112, the lower crossbars 122, and the mounting and fixing bars 123 are all bar-shaped profiles with hollow interiors. The upper crossbars 1112 and the mounting and fixing bars 123 may be made of aluminum alloy profiles, which can reduce the overall weight of the carbon fiber rooftop tent 10 while ensuring the structural strength. Furthermore, the interior of each of the upper frame 1111 and the lower frame 121 may also be a hollow structure, thereby further reducing the overall weight of the carbon fiber rooftop tent 10.

As shown in FIG. 3, FIG. 6, FIG. 9, and FIG. 11, there are two support rods 130 in the tent support assembly 100. The two support rods 130 are respectively located on both sides of the carbon fiber rooftop tent 10 to support the upper cover 110 from both sides. The support rod 130 uses a gas spring, and utilizes the telescopic characteristics of the gas spring to support the upper cover 110 when it is in an open state. Of course, the support rod 130 may also adopt structures such as telescopic rods or spring steel.

The bottom of the upper frame 1111 is of a stepped shape, that is, the outer edge of the bottom of the upper frame 1111 protrudes from the rest of the bottom, so that the rest of the bottom of the upper frame 1111 forms a step surface, and so the side of the upper cover 110 facing the base 120 forms a second receiving groove 152. The cross section of the lower frame 121 is L-shaped, specifically including a lateral side and a vertical side that are perpendicular to each other, so that a first receiving groove 151 is defined in the side of the base 120 facing the upper cover 110. One end of the support rod 130 is fixed to the lateral side of the lower frame 121, and the other end is fixed to the step surface at the bottom of the upper frame 1111. In other words, one end of the support rod 130 is connected to the bottom of the first receiving groove 151, and the other end of the support rod 130 is connected to the bottom of the second receiving groove 152. The first receiving groove 151 and the second receiving groove 152 jointly form an accommodating chamber 150. When the tent support assembly 100 is folded, the edge of the upper cover 110 abuts the edge of the base 120, and the support rod 130 shrinks into the accommodating chamber 150, thereby saving the internal space of the carbon fiber rooftop tent 10, preventing the carbon fiber rooftop tent 10 from increasing in height and volume, and making the folded carbon fiber rooftop tent 10 even smaller in size and easier to carry.

Figure 12:
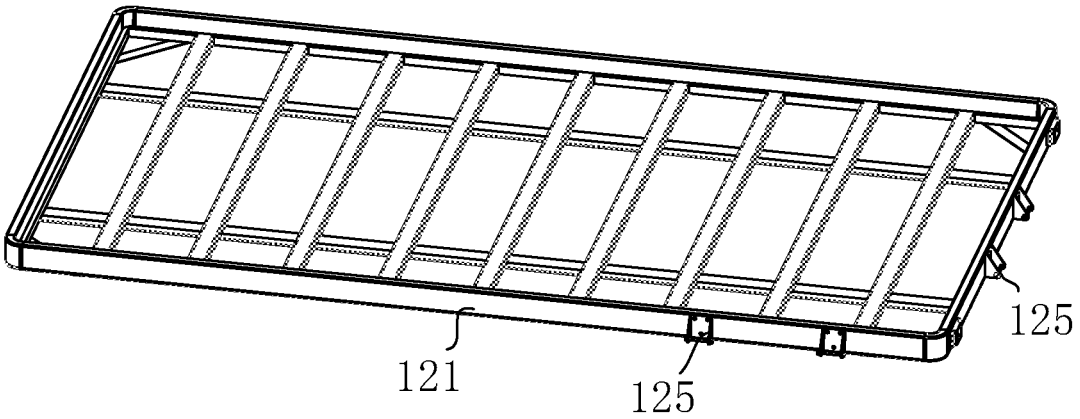
FIG. 12 is a schematic diagram of a tent support assembly including an ladder buckle provided by an embodiment of this application.

As shown in FIG. 12, ladder buckles 125 are also disposed on both sides and the front end of the lower frame 121 for fixing the ladder, so that users can enter the interior of the carbon fiber rooftop tent 10 through the ladder. Furthermore, in the embodiments of this application, ladder buckles 125 are not only disposed at the front end of the lower frame 121 but also on both sides of the lower frame 121 thus meeting the needs of users to enter the interior of the carbon fiber rooftop tent 10 from different positions.

Figure 13:
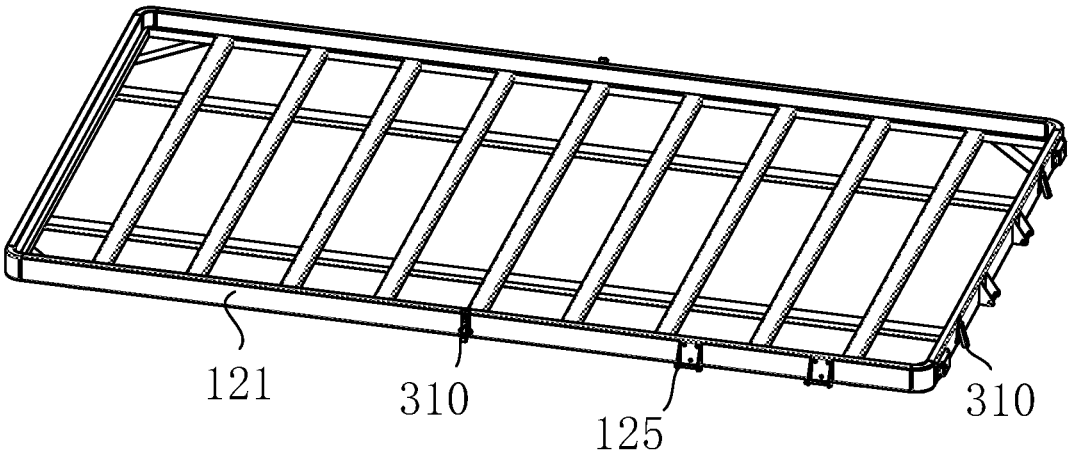
FIG. 13 is a schematic diagram of a tent support assembly including a fastening assembly provided by an embodiment of this application.

As shown in FIG. 3 and FIG. 13, the carbon fiber rooftop tent 10 further includes a fastening assembly 300. The fastening assembly 300 includes a first fastening piece 310 and a second fastening piece 320. The first fastening piece 310 is located in the base 120 and connected to the outer side of the lower frame 121. The second fastening piece 320 is located in the upper cover 110 and connected to the outer side of the upper frame 1111. Through the cooperation of the first fastening piece 310 and the second fastening piece 320, the base 120 and the upper cover 110 are locked together. Specifically, during use, the fastening assembly 300 is opened and the upper cover 110 is lifted. At this time, the support rods 130 hold up the upper cover 110 and the carbon fiber rooftop tent 10 enters the unfolded state. After using the carbon fiber rooftop tent 10, the tent fabric assembly 200 may be retracted into the tent support assembly 100, the upper cover 110 may be pressed to be closed with the base 120, and the fastening assembly 300 may be locked thereby achieving the folding of the carbon fiber rooftop tent 10.

The carbon fiber rooftop tent 10 has four fastening assemblies 300, two of which are located on both sides of the carbon fiber rooftop tent 10, and the other two are located at the front end of the carbon fiber rooftop tent 10, to ensure a good fit between the upper cover 110 and the base 120 after the carbon fiber rooftop tent 10 is folded, preventing the tent fabric assembly 200 from being exposed and preventing external rainwater from entering the interior of the carbon fiber rooftop tent 10.

Regarding the tent fabric assembly 200, the specific design is as follows.

As shown in FIG. 1, in the carbon fiber rooftop tent 10, the tent fabric assembly 200 includes a fabric 210 and a mat 220. The fabric 210 includes multiple connecting positions. The connection position may be a strap, Velcro, or other structures. The fabric 210 is connected to the base 120 and the upper cover 110 through the plurality of connection positions. The fabric 210 is at least connected to the edges of the base 120 and the edges of the upper cover 110 so that the fabric 210 forms a shape matching the tent support assembly 100 when unfolded, thereby reducing the operations of manually organizing the fabric 210. The mat 220 is fixed to the side of the base 120 facing the upper cover 110. When the rooftop tent 10 is unfolded, the fabric 210 and the mat 220 jointly form an inner chamber of the tent.

In the rooftop tent 10, the end where the hinge 140 is located is the rear end, and the end opposite to the rear end is the front end.

Figure 14:
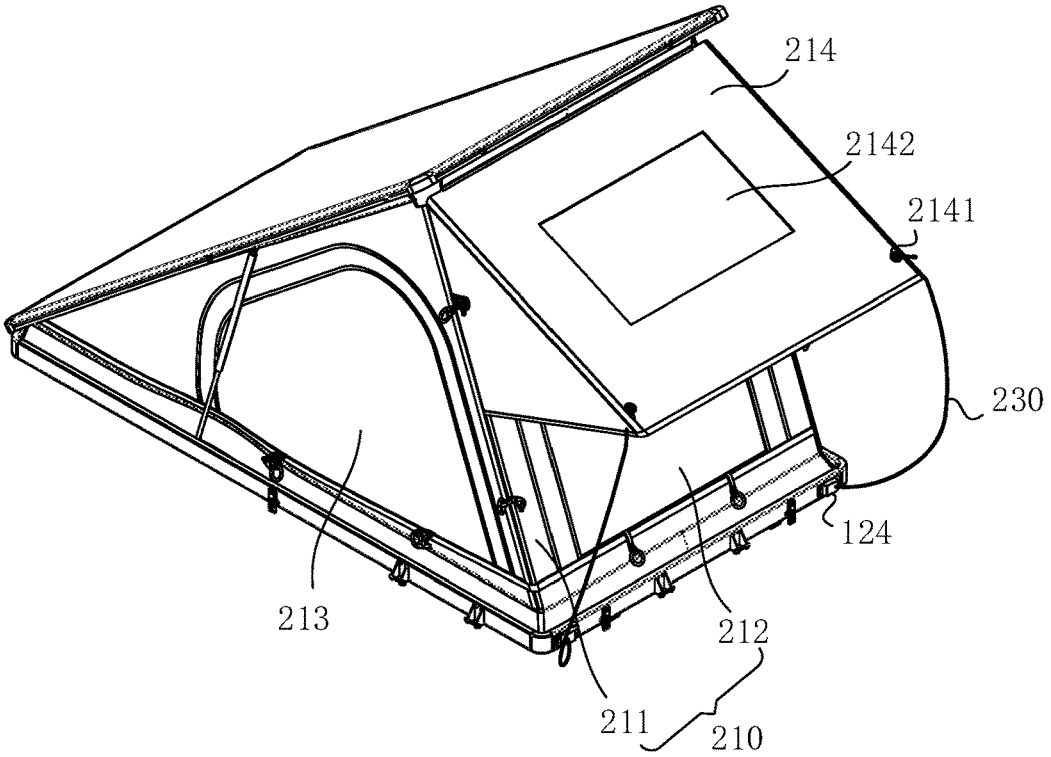
FIG. 14 is a schematic diagram of a portiere provided by an embodiment of this application.

As shown in FIG. 1 and FIG. 14, the fabric 210 includes a main body 211 and a portiere 212. The connection positions are all arranged on the main body 211. The main body 211 is connected to the tent support assembly 100. The portiere 212 is located at the front end of the main body 211 and is connected to the main body 211 and may be opened and closed relative to the main body. Specifically, one side of the portiere 212 may be fixed to the main body 211, and the remaining part may be connected to the main body 211 through a zipper so as to open and close the portiere 212.

Figure 15:
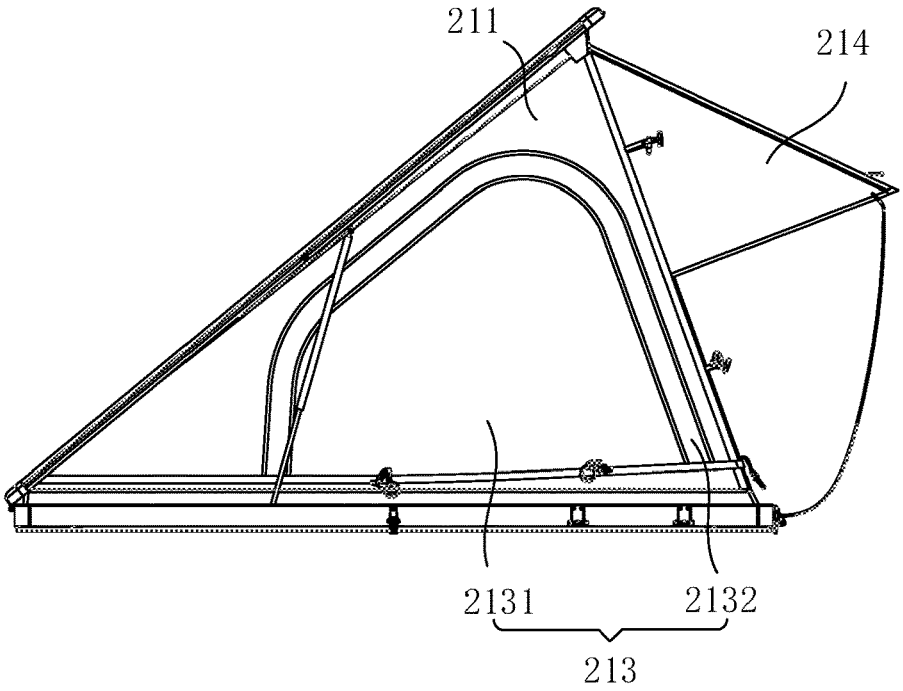
FIG. 15 is a schematic diagram of a window curtain provided by an embodiment of this application.

As shown in FIG. 1 and FIG. 15, the fabric 210 further includes two window curtains 213. The two window curtains 213 are respectively located on both sides of the main body 211. The window curtain 213 is a double-layer structure composed of a window screen 2131 and a fabric curtain 2132. The window screen 2131 and the fabric curtain 2132 are respectively connected to the main body 211 in an openable and closable manner, specifically in the form of a zipper, so that the window screen 2131 and the fabric curtain 2132 may be opened or closed independently.

When the rooftop tent 10 is unfolded, users can enter the interior of the rooftop tent 10 through the portieres 212 and 213 to meet the entry requirements from different directions. After the user enters the interior of the rooftop tent 10, the user can select the open state of the window screen 2131 and the fabric curtain 2132 as needed.

Further, at the front end of the rooftop tent 10, the fabric 210 further includes a shielding piece 214. The shielding piece 214 is located at the front end of the main body 211 and is fixedly connected to the main body 211. The shielding piece 214 is also located above the portiere 212 for blocking light and rain. The shielding piece 214 includes a transparent piece 2142. After entering the rooftop tent 10, the user can open the portiere 212 and watch the starry sky through the transparent piece 2142.

Fixing rings 2141 may be disposed on two sides of the shielding piece 214. The fixing ring 2141 may be a metal ring, which can be fixed in the shielding piece 214 by pressing. An insert seat 124 may be disposed on each of both sides of the front end of the base 120. The insert seat 124 is specifically located on the outer surface of the front end of the lower frame 121. It may be an integral metal piece and is fixed to the lower frame 121 with screws. The tent fabric assembly 200 further includes two pull rods 230. One end of the pull rod 230 is connected to the fixing ring 2141, and the other end is connected to the corresponding insert seat 124 to stretch the shielding piece 214.

Specifically, the pull rod 230 is an elastic member, such as an integrally formed spring steel structure. One end of the pull rod 230 has a hook that cooperates with the fixing ring 2141. When the pull rod 230 is not mounted, the entire pull rod 230 is straight, making it easy for storage.

Figure 16:
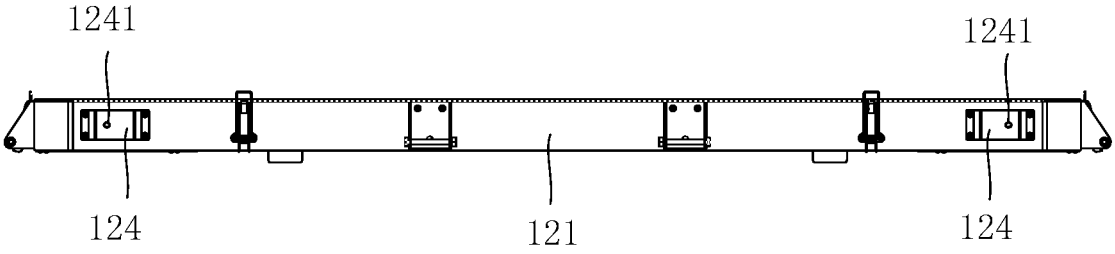
FIG. 16 is a schematic diagram of an insert seat provided by an embodiment of this application.

As shown in FIG. 16, the insert seat 124 includes an insert hole 1241. The insert hole 1241 is an oblique hole, and the extending directions of the insert holes 1241 in the two insert seats 124 are opposite to each other. When the pull rod 230 is mounted, one end of the pull rod 230 is inserted obliquely outward into the insert hole 1241, and the other end of the pull rod 230 hooks the fixing ring 2141. At this time, the pull rod 230 is bent, and the middle of the pull rod 230 protrudes outward, exerting an outward pulling force on both ends of the shielding piece 214 to further straighten the shielding piece 214, so that the overall visual effect of the tent fabric assembly 200 is better.

Of course, the pull rod 230 may also adopt a non-elastic structure. For example, the pull rod 230 may be made into a fixed arc-shaped structure, which may also achieve the effect of stretching the tent fabric assembly 200.

Figure 17:
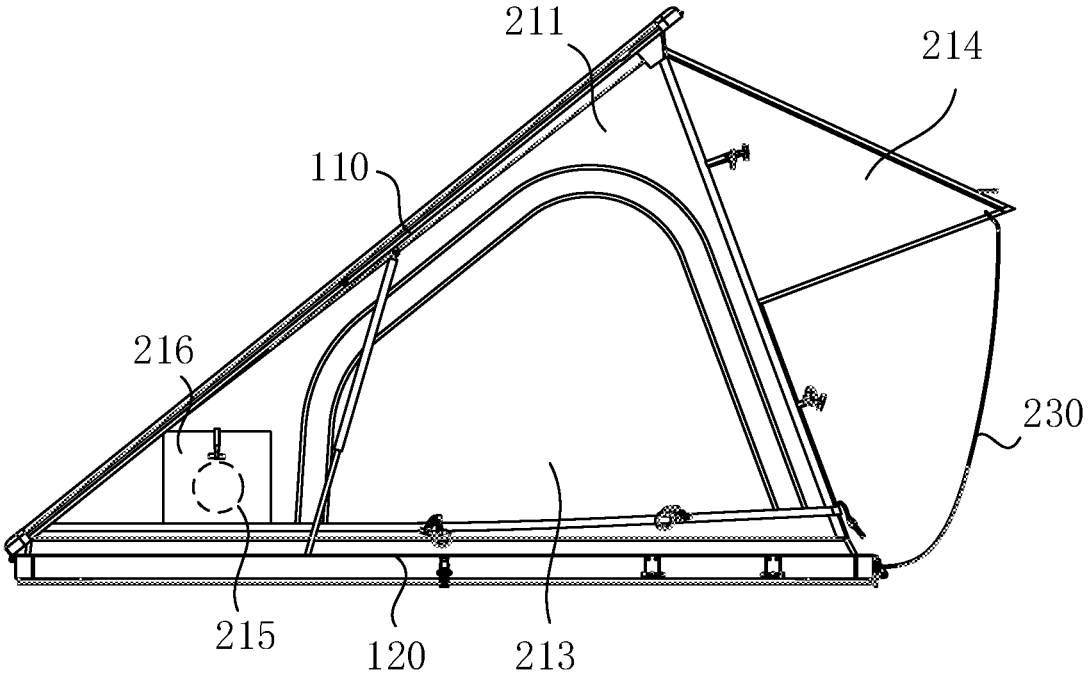
FIG. 17 is a schematic diagram of a duct and a sealing piece provided by an embodiment of this application.

As shown in FIG. 1 and FIG. 17, the fabric 210 further includes a duct 215 and a sealing piece 216. The duct 215 and the sealing piece 216 are both disposed on a side of the main body 211 and between the window curtain 213 and the rear end, specifically at a corner of the tent support assembly 100. The duct 215 is a tubular fabric structure that can be folded, and the duct 215 penetrates through the main body 211 to connect the outside world with the inner chamber of the tent. In cold or hot weather, the heating or cold air in the automobile may be passed through the duct 215 using an air pipe to be delivered into the inner chamber of the tent to improve the user's experience.

The sealing piece 216 is located outside the duct 215 and covers the duct 215, and is connected with the main body 211 in an openable and closable manner. When there is no need to introduce heating or cooling into the tent, the sealing piece 216 may be directly covered on the duct 215 to prevent mosquitoes or foreign objects from entering the inner chamber of the tent. When it is needed to introduce heating or cooling into the tent, the sealing piece 216 may be directly opened to expose the duct 215, which is convenient to use.

In the fabric 210, the main body 211, portiere 212, fabric curtain 2132, shielding piece 214, duct 215, and sealing piece 216 may be made of the same material, such as nylon, polyvinyl chloride and other fabrics, which have desirable windproof and waterproof properties. Furthermore, the main body 211, the portiere 212, the fabric curtain 2132, the shielding piece 214, the duct 215, and the sealing piece 216 may collectively be an integrated structure. They may also be independent structures, and the complete fabric 210 may be obtained by subsequent sewing.

Figure 18:
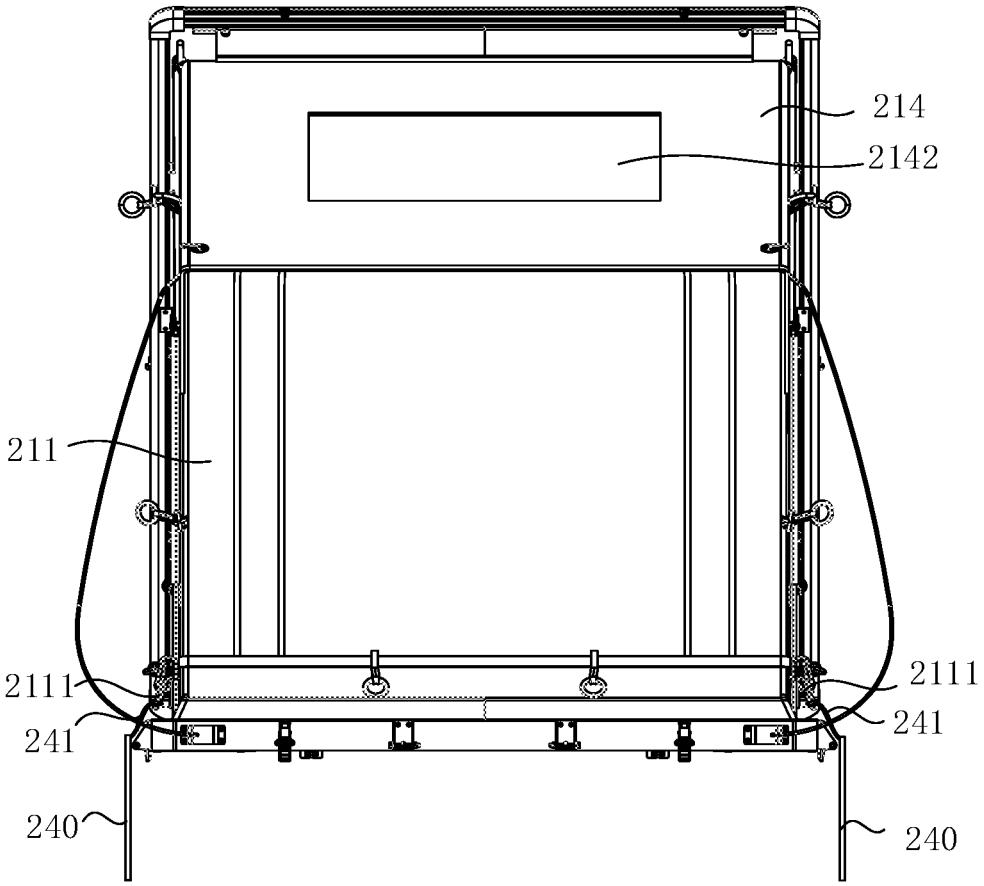
FIG. 18 is a schematic diagram of a rooftop tent with an item bag provided by an embodiment of this application.

As shown in FIG. 18, the bottom of the main body 211 includes a parent buckle 2111. The tent fabric assembly 200 further includes an item bag 240. The item bag 240 includes a child buckle 241 that matches the parent buckle 2111. The item bag 240 is fixed to the main body 211 through the cooperation of the parent buckle 2111 and the child buckle 241. The user may choose to install the item bag 240 according to his needs. After choosing to install the item bag 240, the item bag 240 may be hung outside the rooftop tent 10, and shoes or other items may be put into the item bag 240 for storage to facilitate organization.

It can be seen that the rooftop tent 10 provided in the embodiments of this application can meet the needs of many users and has strong market competitiveness.

The foregoing is merely a further detailed description of this application with reference to some specific illustrative embodiments, and the specific implementations of this application are not to be construed to be limited to these illustrative embodiments. For those having ordinary skill in the technical field to which this application pertains, numerous deductions or substitutions may be made without departing from the concept of this application, which shall all be regarded as falling in the scope of protection of this application.

What is claimed is:

1. A carbon fiber rooftop tent, comprising a tent support assembly and a tent fabric assembly fixed to the tent support assembly, the tent support assembly comprising:

a base, used to be mounted on top of an automobile;

an upper cover, wherein one end of the upper cover is connected to one end of the base through a hinge, and wherein the upper cover is rotatable relative to the base by means of the hinge; and at least one support rod, disposed between the base and the upper cover and used to support the upper cover; wherein one end of each of the at least one support rod is connected to the base, and another end of the support rod is connected to the upper cover;

wherein the upper cover is at least partially made of a carbon fiber material;

wherein the base defines a first receiving groove on a side facing the upper cover, and the upper cover defines a second receiving groove on a side facing the base, wherein the first receiving groove and the second receiving groove jointly define an accommodating chamber;

wherein one end of each of the at least one support rod is connected to a bottom of the first receiving groove, and another end of the support rod is connected to a bottom of the second receiving groove; wherein when the rooftop tent is folded, the support rod is disposed in the accommodating chamber, and wherein an edge of the base abuts against an edge of the upper cover;

wherein the base comprises a lower frame, a plurality of lower crossbars arranged at intervals, and at least two mounting and fixing bars arranged at intervals; wherein two ends of each of the plurality of lower crossbars are respectively connected to two opposite sides of the lower frame, and wherein two ends of each of the at least two mounting and fixing bars are respectively connected to another two opposite sides of the lower frame; wherein a side of the lower frame facing the upper cover defines an L-shaped notch to form the first receiving groove;

wherein the upper cover comprises an upper frame, a top plate, and at least two upper crossbars, wherein an inner wall of the upper frame defines a fitting groove, and edges of the top plate are engaged in the fitting groove; wherein two ends of each of the at least two upper crossbars are respectively connected to two opposite sides of the upper frame, and wherein the at least two upper crossbars are arranged in sequence on a side of the top plate facing the base; wherein the side of the upper frame facing the base further comprises an L-shaped notch to form the second receiving groove.

2. The carbon fiber rooftop tent as recited in claim 1, wherein the upper cover comprises a framework and a top plate, wherein one end of the framework is connected to the corresponding end of the base through the hinge; wherein the top plate is made of the carbon fiber material and is fixed to the framework.

3. The carbon fiber rooftop tent as recited in claim 2, wherein the framework comprises an upper frame and at least two upper crossbars, wherein an inner wall of the upper frame defines a fitting groove, and wherein edges of the top plate are engaged in the fitting groove; wherein two ends of each of the at least two upper crossbar are respectively connected to two opposite sides of the upper frame, and wherein the at least two upper crossbars are arranged at intervals on a side of the top plate facing the base.

4. The carbon fiber rooftop tent as recited in claim 3, wherein a junction between the top plate and the upper frame is coated with a waterproof glue.

5. The carbon fiber rooftop tent as recited in claim 1, wherein the base comprises a lower frame, a plurality of lower crossbars disposed at intervals, and at least two mounting and fixing bars disposed at intervals, wherein one end of the lower frame is connected to the upper cover through the hinge;

wherein two ends of each of the plurality of lower crossbars are respectively connected to two opposite sides of the lower frame, and wherein two ends of each of the at least two mounting and fixing bars are respectively connected to another two opposite sides of the lower frame;

wherein at least one of the plurality of lower crossbars is made of the carbon fiber material, and wherein the plurality of lower crossbars is disposed between the at least two mounting and fixing bars and the upper cover.

6. The carbon fiber rooftop tent as recited in claim 5, wherein in the carbon fiber rooftop tent, an end where the hinge is located is a rear end, and an end opposite to the rear end is a front end;

wherein the plurality of lower crossbars are arranged in sequence from the front end to the rear end, and wherein the two lower crossbars nearest to the front end are made of an aluminum alloy material, and wherein the remaining lower crossbars are made of the carbon fiber material.

7. The carbon fiber rooftop tent as recited in claim 5, wherein an inner wall of the lower frame defines a plurality of insertion sockets, and wherein two ends of each of the plurality of lower crossbars are inserted into the respective insertion sockets so as to be connected to the lower frame;

wherein two ends of each of the at least two mounting and fixing bars are each fixed to the bottom of the lower frame through a screw connection.

8. The carbon fiber rooftop tent as recited in claim 5, wherein a fixing rail is arranged on a side of each of the at least two mounting and fixing bars facing away from the plurality of lower crossbars, and wherein each fixing rail comprises a plurality of mounting positions used for fixing to the automobile;

wherein each fixing rail extends along a length of the respective mounting and fixing bar; wherein at least one first screw hole is defined at each of two ends of the fixing rail; wherein the at least one first screw hole corresponds to the bottom of the lower frame, and wherein each of the at least two mounting and fixing bars is fixed to the bottom of the lower frame through screws.

9. The carbon fiber rooftop tent as recited in claim 8, wherein each of the at least two mounting and fixing bars further defines a plurality of second screw holes, which are disposed in one-to-one correspondence with the plurality of lower crossbars;

wherein the plurality of second screw holes are disposed outside the respective fixing rail, and wherein the second screw holes are alternately disposed on two sides of the fixing rail, and wherein each mounting and fixing bar is connected to the plurality of lower crossbars through screws.

10. The carbon fiber rooftop tent as recited in claim 5, further comprising a fastening assembly that is connected to the base and the upper cover and that is used to fasten the base and the upper cover together after the carbon fiber rooftop tent is folded.

11. The carbon fiber rooftop tent as recited in claim 1, wherein the at least one support rod comprises a gas spring.

12. The carbon fiber rooftop tent as recited in claim 1, wherein the tent fabric assembly comprises a fabric and a mat, wherein the fabric comprises a plurality of connection positions and is connected to the base and the upper cover through the plurality of connection positions; wherein the mat is fixed to a side of the base facing the upper cover; wherein when the rooftop tent is unfolded, the fabric and the mat jointly define an inner chamber of the tent.

13. The carbon fiber rooftop tent as recited in claim 12, wherein in the rooftop tent, an end where the hinge is located is a rear end, and wherein an end opposite to the rear end is a front end;

wherein the fabric comprises a main body, a portiere, and two window curtains, wherein the plurality of connecting positions are disposed on the main body, wherein the two window curtains are respectively disposed on two sides of the main body, wherein the two window curtains are each a double-layer structure composed of a window screen and a fabric curtain; wherein the window screen and the fabric curtain are each connected to the main body and are each openable and closable relative to the main body; wherein the portiere is disposed at the front end of the main body and is connected to the main body, and wherein the portiere is openable and closable relative to the main body.

14. The carbon fiber rooftop tent as recited in claim 13, wherein the fabric further comprises a shielding piece disposed at the front end of the main body and fixedly connected to the main body, wherein the shielding piece is disposed above the portiere; wherein there is disposed a fixing ring disposed on each of both sides of the shielding piece, and wherein there is disposed an insert seat on each of both sides of the front end of the base, wherein the tent fabric assembly further comprises two pull rods, wherein one end of each of the two pull rods is connected to the respective fixing ring, and wherein another end of the pull rod is connected to the respective insert seat to stretch the shielding piece.

15. The carbon fiber rooftop tent as recited in claim 14, wherein each insert seat defines an insert hole, which is an oblique hole, wherein extending directions of the insert holes in the two insert seats are opposite to each other;

wherein the two pull rods are each an elastic member, and wherein one end of each of the two pull rods comprises a hook that matches the respective fixing ring.

16. The carbon fiber rooftop tent as recited in claim 15, wherein the two pull rods area each made of a spring steel material that is integrally formed.

17. The carbon fiber rooftop tent as recited in claim 13, wherein the fabric further comprises a duct and a sealing piece that are both disposed on a side of the main body and between the respective window curtain and the rear end;

wherein the duct penetrates through the main body and connects an outside world with the inner chamber of the tent; wherein the sealing piece is disposed to cover the duct and is connected with the main body in an openable and closable manner relative to the main body.

18. The carbon fiber automobile rooftop tent as recited in claim 13, wherein there is disposed a parent buckle at a bottom of the main body, wherein the tent fabric assembly further comprises an item bag, which comprises a child buckle that matches the parent buckle, and wherein the item bag is fixed to the main body by means of mating of the parent buckle and the child buckle.

* * * * *